US010395796B2

(12) United States Patent
Kobayashi et al.

(10) Patent No.: US 10,395,796 B2
(45) Date of Patent: Aug. 27, 2019

(54) FLAT CABLE AND WATERPROOF CABLE

(71) Applicants: AUTONETWORKS TECHNOLOGIES, LTD., Yokkaichi-shi, Mie (JP); SUMITOMO WIRING SYSTEMS, LTD., Yokkaichi-shi, Mie (JP); SUMITOMO ELECTRIC INDUSTRIES, LTD., Osaka-shi, Osaka (JP)

(72) Inventors: Kenta Kobayashi, Yokkaichi (JP); Makoto Higashikozono, Yokkaichi (JP); Hirokazu Komori, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/300,375

(22) PCT Filed: Apr. 27, 2017

(86) PCT No.: PCT/JP2017/016815

§ 371 (c)(1),
(2) Date: Nov. 9, 2018

(87) PCT Pub. No.: WO2017/195640

PCT Pub. Date: Nov. 16, 2017

(65) Prior Publication Data

US 2019/0131031 A1 May 2, 2019

(30) Foreign Application Priority Data

May 13, 2016 (JP) ..... 2016-097232

(51) Int. Cl.

| | |
|---|---|
| ***H01B 7/08*** | (2006.01) |
| ***H01B 7/00*** | (2006.01) |
| ***H01B 7/282*** | (2006.01) |
| ***H01B 7/18*** | (2006.01) |

(Continued)

(52) U.S. Cl.
CPC ..... *H01B 7/0876* (2013.01); *H01B 7/00* (2013.01); *H01B 7/08* (2013.01); *H01B 7/1805* (2013.01);

(Continued)

(58) Field of Classification Search
CPC ..... H01B 7/18; H01B 7/1815; H01B 7/00; H01B 7/08; H01B 7/0876; H01B 7/1805;

(Continued)

(56) References Cited

U.S. PATENT DOCUMENTS 4,099,038 A * 7/1978 Purdy ..... F41F 3/055 102/206
6,627,817 B1 * 9/2003 Kortenbach ..... H02G 3/083 174/541

(Continued)

FOREIGN PATENT DOCUMENTS

JP S60-161310 U 10/1985
JP 2005-100877 A 4/2005

(Continued)

OTHER PUBLICATIONS

Jul. 11, 2017 International Search Report issued in International Patent Application No. PCT/JP2017/016815.

*Primary Examiner* — Timothy J Thompson
*Assistant Examiner* — Rhadames Alonzo Miller
(74) *Attorney, Agent, or Firm* — Oliff PLC

(57) ABSTRACT

A flat cable that includes a plurality of cores each including one insulated wire and/or a plurality of insulated wires that are twisted together, the cores being lined up in a cable width direction, which is orthogonal to a longitudinal direction of the insulated wires; a sheath that collectively covers the plurality of cores; and a space that is surrounded by an outer surface of one of the plurality of cores, an outer surface of another one of the plurality of cores that is adjacent to the (Continued)

one of the plurality of cores, and an inner surface of the sheath.

7 Claims, 6 Drawing Sheets

(51) Int. Cl.
*H01R 13/52* (2006.01)
*H01R 43/00* (2006.01)

(52) U.S. Cl.
CPC ..... *H01B 7/282* (2013.01); *H01R 13/5205* (2013.01); *H01R 43/005* (2013.01)

(58) Field of Classification Search
CPC ..... H01B 7/282; H01B 7/181; H01B 7/189; H01B 7/1895; H01R 13/5205; H01R 43/005
See application file for complete search history.

(56) References Cited

U.S. PATENT DOCUMENTS

2002/0126457 A1* 9/2002 Kameyama ..... H01R 13/6658 361/728
2007/0037436 A1* 2/2007 Iwahori ..... H01R 13/5205 439/422
2008/0032548 A1* 2/2008 Shigehisa ..... H01R 4/185 439/516
2010/0078847 A1* 4/2010 Lind ..... H02G 3/0462 264/171.13
2010/0080520 A1* 4/2010 Lind ..... H02G 3/0462 385/101
2012/0018196 A1* 1/2012 Lin ..... H05K 1/0253 174/254
2013/0023140 A1* 1/2013 Kondo ..... H01R 12/68 439/277
2013/0109212 A1* 5/2013 Ohyama ..... H01R 13/5205 439/272
2013/0330963 A1* 12/2013 Miura ..... H01R 12/777 439/492
2014/0154916 A1* 6/2014 Jinno ..... H01R 12/771 439/587
2017/0374290 A1* 12/2017 Ootorii ..... G03B 15/00
2018/0248284 A1* 8/2018 Saoya ..... H01R 12/67

FOREIGN PATENT DOCUMENTS

JP 2011-228043 A 11/2011
JP 2016-10303 A 1/2016

* cited by examiner

FLAT CABLE AND WATERPROOF CABLE

This application is the U.S. National Phase of PCT/JP2017/016815 filed Apr. 27, 2017, which claims priority from JP 2016-097232 filed May 13, 2016, the entire disclosure of which is incorporated herein by reference.

BACKGROUND

The present disclosure relates to a flat cable and a waterproof cable.

Conventionally, multi-core cables each including a plurality of insulated wires, and a sheath that collectively covers the insulated wires have been used in a variety of fields. A flat cable having a flat cross section orthogonal to the longitudinal direction is known as a multi-core cable of this kind. Flat cables are more flexible than cables having a circular cross section, and thus have been used in, for example, a location with a narrow routing space, and a location that is repeatedly subjected to bending while the device is used.

If water, a foreign object, or the like enters the inside of the sheath or the inside of the insulated wires from a terminal end of a flat cable, there is the possibility that abrasion may be caused by the frozen moisture or the foreign object, resulting in damage to the insulated wires. To prevent such problems, waterproofing may be performed on the terminal end portion of the flat cable. For example, methods such as a method involving filling any gap present at the terminal end with a potting resin, and a method involving covering the outer circumference of the terminal end portion with a molding resin, are often used as the waterproofing.

There has also been proposed a technique by which a rubber stopper including a sheath-side lip that is in intimate contact with the outer circumference of the sheath, and a wire-side lip that is in intimate contact with the outer circumference of the insulated wires is attached to a terminal end portion of a multi-core cable having a circular cross section (JP 2016-10303A).

SUMMARY

However, a conventional waterproofing treatment performed with a potting resin or a molding resin tends to result in an increase in the number of processing steps and also an increase in the time required for each processing step, thus increasing the man-hours. Furthermore, the conventional waterproofing treatment tends to cause variation in the waterproofing performance, and therefore is still susceptible to improvement from the viewpoint of readily ensuring the waterproofing performance.

Unlike a multi-core cable having a circular cross section as that described in JP 2016-10303A, the surface pressure applied by the rubber stopper to the outer surface of the sheath of a flat cable is less likely to be uniform. For example, the surface pressure applied to a flat portion of the sheath is less likely to be reduced as compared with the surface pressure applied to opposite end portions in the cable width direction. In addition, the flat portion of the sheath has a relatively low rigidity, and thus tends to be depressed inward, being unable to withstand the pressing force of the rubber stopper. When the flat portion of the sheath undergoes such deformation, the surface pressure applied to the flat portion of the sheath is further reduced. Accordingly, attaching a rubber stopper as that proposed by JP 2016-10303A to the terminal end portion of the flat cable poses the problem that water or the like easily enters the inside of the sheath or the inside of the insulated wires from between the rubber stopper and the flat portion of the sheath.

An exemplary aspect of the disclosure provides a flat cable capable of waterproofing the terminal end portion using the rubber stopper, and a waterproof cable including the flat cable.

An aspect of the present disclosure provides a flat cable including: a plurality of cores each including one insulated wire and/or a plurality of insulated wires that are twisted together, the cores being lined up in a cable width direction, which is orthogonal to a longitudinal direction of the insulated wires; a sheath that collectively covers the plurality of cores; and a space that is surrounded by an outer surface of one of the plurality of cores, an outer surface of another one of the plurality of cores that is adjacent to the one of the plurality of cores, and an inner surface of the sheath, wherein the sheath includes: a pair of sheath ends respectively located along outer surfaces of cores of the plurality of cores that are disposed at opposite ends; a coupler that couples the pair of sheath ends; and a reinforcement that is formed integrally with the coupler, and is provided outward of a portion of the coupler that covers the space.

Another aspect of the present disclosure provides a waterproof cable including: the flat cable described above; and a rubber stopper attached to a terminal end of the flat cable, wherein the terminal end includes the sheath, and the insulated wires protruding from the sheath, and the rubber stopper includes: a sheath-covering that covers the sheath; a wire-covering that is connected with the sheath-covering, and that covers a protrusion of the insulated wires; and a through hole that is formed in the wire-covering, and through which each of the protrusions is passed.

The sheath of the flat cable includes the pair of sheath ends, the coupler that couples the pair of sheath ends, and the reinforcement provided outward of a portion of the coupler that covers the space. Since the portion of the sheath that covers the space includes the reinforcement, in addition to the coupler, it is possible to inhibit the portion of the sheath that covers the space from being depressed inward when the rubber stopper is attached to the terminal end of the flat cable. Accordingly, the flat cable can apply a sufficiently large surface pressure to the outer surface of the sheath when the rubber stopper is attached to its terminal end. As a result, the flat cable can waterproof the terminal end using the rubber stopper.

By providing the reinforcement in the sheath, it is possible to sufficiently increase the surface pressure applied to the outer surface of the sheath even when a rubber stopper with a shape not corresponding to the shape of the sheath is attached. Therefore, with the flat cable, it is possible to use the same rubber stopper for a variety of flat cables with different shapes and sizes. As a result, it is possible to expect the effect of reducing the time and labor, the cost, and the like required to change the shape of the rubber stopper.

The waterproof cable includes a flat cable having the above-described configuration, and the rubber stopper attached to the terminal end of the flat cable. In the waterproof cable, by the sheath-covering pressing the sheath ends and the reinforcement, it is possible to inhibit the entry of water or the like to the inside or the like of the sheath from between the sheath-covering and the sheath. By the wire-covering pressing the protrusion of the insulated wire, it is possible to inhibit the entry of water or the like to the inside or the like of the insulated wire from between the wire-covering and the protrusion. Accordingly, the waterproof cable has excellent waterproofing performance.

DETAILED DESCRIPTION OF EMBODIMENTS

Figure 1:
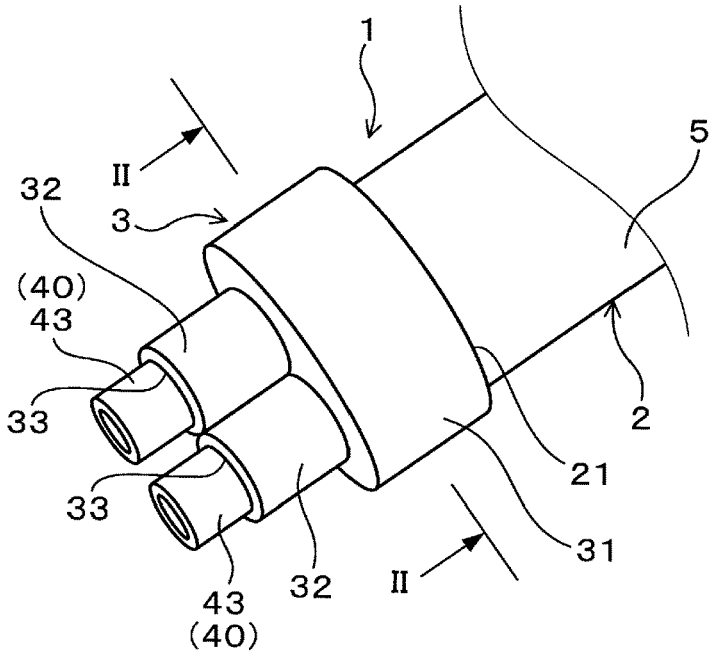
FIG. 1 is a perspective view of a waterproof cable according to Embodiment 1.

In the above-described flat cable, each core may be a single-wire core constituted by one insulated wire, or may be a stranded-wire core composed of a plurality of insulated wires that are twisted together. As the insulated wire, it is possible to use a known insulated wire including a conductor, and an insulator that covers the conductor.

Inside the sheath, cores having the same configuration may be disposed, or cores having different configurations may coexist. For example, in the case where two cores are disposed inside the sheath, both of the cores may be single-wire cores, or both of the cores may be stranded-wire cores. Alternatively, one of the cores may be a single-wire core, and the other core may be a stranded-wire core. In the case where three or more cores are disposed inside the sheath, it is also possible to use, as in the above-described case, a configuration in which all the cores are single-wire cores, a configuration in which all the cores are stranded-wire cores, and a configuration in which single-wire cores and stranded-wire cores coexist.

The outer diameters of the cores disposed inside the sheath may be the same, or they may be different from each other. Note that the outer diameter of a single-wire core is the diameter of the insulated wire constituting the core. The outer diameter of the stranded-wire core is the diameter of a circumscribed circle including all the insulated wires in a cross section in the longitudinal direction.

The sheath includes the pair of sheath end portions (i.e., sheath ends) disposed along outer surfaces of those of the plurality of cores that are disposed at opposite ends, a coupling portion (i.e., coupler) that couples the pair of sheath end portions, and the reinforcing portion (i.e., reinforcement) provided outward of a portion of the coupling portion that covers the hollow portion (i.e., space).

A central portion of the reinforcing portion in the cable width direction may have a thickness that is larger than a thickness of an end portion thereof in the cable width direction. In this case, it is possible to further increase the surface pressure applied to the reinforcing portion when the rubber stopper is attached to the terminal end portion (i.e., terminal end) of the flat cable. As a result, the waterproofing performance can be further enhanced.

An outer surface of the reinforcing portion may have an arc shape in a cross section perpendicular to a longitudinal direction of the flat cable. In this case, it is possible to reduce the unevenness on the outer surface of the reinforcing portion, and it is therefore more difficult for a gap to be formed between the rubber stopper and the reinforcing portion. As a result, the waterproofing performance can be further enhanced.

Preferably, the reinforcing portion is provided over the entirety of the coupling portion in the cable width direction. When a rubber stopper is attached to a terminal end portion of a flat cable, the surface pressure exerted by the rubber stopper becomes the highest at the sheath end portions, and tends to be reduced toward the center of the sheath in the cable width direction. To deal with this, it is possible to apply a sufficiently large surface pressure to the entire reinforcing portion by placing the reinforcing portion over the entirety of the coupling portion in the cable width direction. As a result, the waterproofing performance can be further enhanced.

Preferably, an outer surface of the sheath has an oval shape in a cross section perpendicular to a longitudinal direction of the flat cable. The above-described "oval shape" includes an oval and shapes similar to an oval, in which curves constituting the outer surfaces of the sheath end portions and a curve constituting the outer surface of the reinforcing portion are smoothly connected. Examples of shapes similar to an oval include an egg shape and a shape formed by causing the flat portion of an elongated circle to bulge outward. Shapes in which the outer surface of the sheath has projections and recesses and the boundaries between the recess and the projections can be clearly viewed are excluded from the above-described "oval shape".

By configuring the shape of the sheath to be any of the above-described predetermined shapes, it is more difficult for a gap to be formed between the rubber stopper and the sheath when the rubber stopper is attached to the terminal end portion of the flat cable. Furthermore, in this case, it is possible to apply a sufficiently large surface pressure to the outer surface of the sheath. As a result, the waterproofing performance can be further enhanced.

As described above, it is preferable that the reinforcing portion is provided over the entirety of the coupling portion in the cable width direction. However, the reinforcing portion may be provided so as to be separated for the respective corresponding portions of the coupling portion that cover the hollow portion.

Specific examples of the material of the sheath include a polyurethane resin and a vinyl chloride resin. In terms of the resistance to external damage, abrasion, and the like, it is preferable to use a polyurethane resin as the material of the sheath.

A hollow portion surrounded by an outer surface of one of the plurality of cores, an outer surface of another one of the cores that is adjacent to the aforementioned core, and the inner surface of the sheath is formed inside the sheath. An intervening object made of paper, a polyolefin resin such as polyethylene, talc, or the like may be disposed inside the hollow portion. It is possible to reduce the unevenness on the core surface by placing the intervening object inside the hollow portion. As a result, it is possible to further reduce the unevenness on the sheath outer surface resulting from the unevenness on the core surface, and, therefore, an automobile composite cable having a good appearance with little waviness or the like can be obtained.

The waterproof cable can be produced by removing the sheath that is present at the terminal end portion of the flat cable to expose the insulated wires, and subsequently attaching the rubber stopper to the terminal end portion. The rubber stopper may include: a sheath-covering portion (i.e., sheath-covering) that covers the sheath; a wire-covering portion (i.e., wire-covering) that is connected with the sheath-covering portion, and that covers a protruding portion (i.e., protrusion) of the insulated wires; and a through hole that is formed in the wire-covering portion, and through which each of the protruding portions is passed. Examples of the material of the rubber stopper include a silicone rubber and a polyurethane rubber.

The waterproof cable may further include a housing portion (i.e., housing) that covers the rubber stopper, wherein the housing portion may include a sheath-pressing pressing the sheath-covering portion inward, and a wire-pressing pressing the wire-covering portion inward. In this case, it is possible to reliably bring the sheath-covering portion into intimate contact with the outer surface of the sheath, and also to reliably bring the wire-covering portions into intimate contact with the outer surfaces of the respective insulated wires. Therefore, the waterproofing performance can be further enhanced. Examples of the material of the housing portion include hard plastics such as polybutylene terephthalate and nylon.

Embodiments

Embodiment 1

Figure 2:
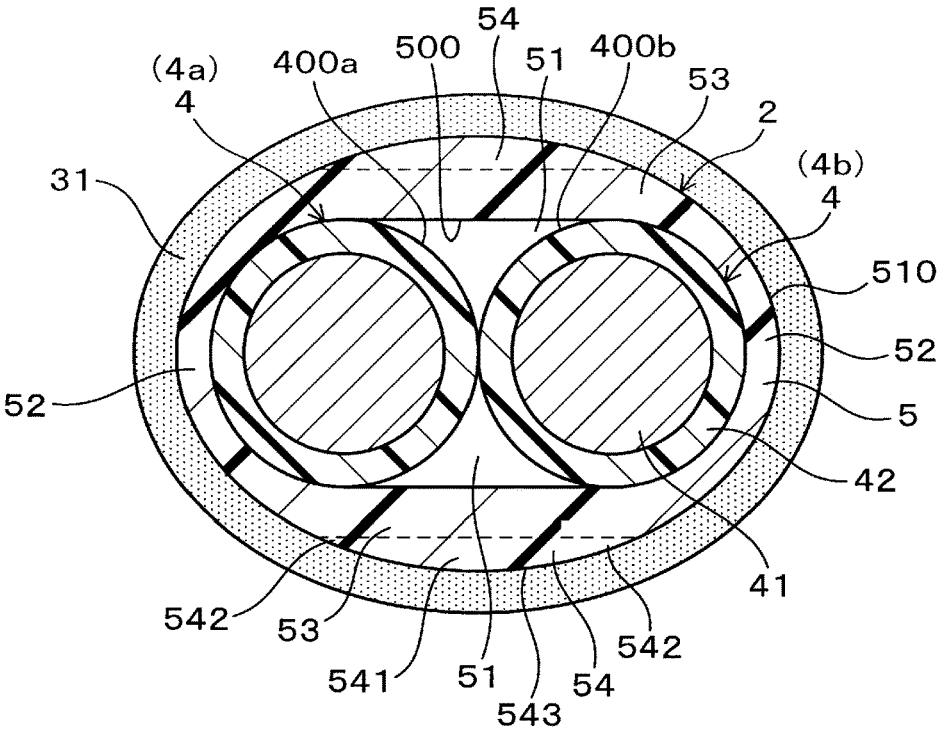
FIG. 2 is a cross-sectional view taken in the direction of arrows II-II in FIG. 1.

An embodiment of a waterproof cable including the above-described flat cable will be described with reference to the drawings. As shown in FIG. 1, a waterproof cable 1 includes a flat cable 2, and a rubber stopper 3 attached to a terminal end portion 21 of the flat cable 2. As shown in FIG. 2, the flat cable 2 includes a plurality of cores 4, and a sheath 5 that collectively covers the plurality of cores 4. The cores 4 each include one insulated wire 40 and/or a plurality of insulated wires 40, and are lined up in a cable width direction, which is orthogonal to a longitudinal direction of the insulated wires 40. A hollow portion 51 that is surrounded by an outer surface 400*a* of one of the plurality of cores 4 (4*a*, 4*b*), namely, the core 4*a*, an outer surface 400*b* of a core 4*b* adjacent to the core 4*a*, and an inner surface of the sheath 5 is formed inside the sheath 5.

The sheath 5 includes a pair of sheath end portions 52 located along the outer surfaces 400*a* and 400*b* of the cores 4*a* and 4*b* disposed at opposite ends of the plurality of cores 4, coupling portions 53 that couple the pair of sheath end portions 52, and reinforcing portions 54 that are formed integrally with the coupling portions 53 and are provided outward of that part of the coupling portions 53 that covers the hollow portion 51.

As shown in FIG. 1, the terminal end portion 21 of the flat cable 2 includes the sheath 5, and the insulated wires 40 protruding from the sheath 5. The rubber stopper 3 includes a sheath-covering portion 31 that covers the sheath 5, and wire-covering portions 32 that are connected with the sheath-covering portion 31 and cover the protruding portions 43 of the respective corresponding insulated wires 40. A through hole 33 is formed in each of the wire-covering portions 32, and the insulated wires 40 are passed through the respective corresponding through holes 33.

As shown in FIG. 2, the flat cable 2 of the present embodiment includes two cores 4 inside the sheath 5. Each core 4 is a single-wire core constituted by one insulated wire 40 including a conductor 41, and an insulator 42 that covers the conductor 41. The two cores 4 are disposed such that their respective insulators 42 abut against each other.

The sheath end portions 52 each have a semicircular shape in a cross section perpendicular to the longitudinal direction. The coupling portions 53 have a linear shape extending in the cable width direction in the aforementioned cross section. The reinforcing portions 54 are formed integrally with the coupling portions 53, and are provided over the entirety of the coupling portions 53 in the cable width direction. A central portion 541 of the reinforcing portions 54 in the cable width direction has a thickness that is larger than the thickness of end portions 542 thereof in the cable width direction. Furthermore, an outer surface 543 of the reinforcing portions 54 has an arc shape in a cross section perpendicular to the longitudinal direction of the flat cable 2.

An outer surface 510 of the sheath 5 has an oval shape in a cross section perpendicular to the longitudinal direction of the flat cable 2. That is, in the aforementioned cross section, the outer surfaces of the sheath end portions 52, and the outer surface of the reinforcing portions 54 are smoothly connected. The inner surface of the sheath 5 has an elongated circular shape defined by connecting a pair of semicircles constituted by the inner surfaces of the pair of sheath end portions 52, and straight lines constituted by an inner surface 500 of the coupling portions 53.

The outer surface 510 of the sheath 5 is covered by the sheath-covering portion 31 of the rubber stopper 3. The sheath-covering portion 31 of the present embodiment has a tubular shape corresponding to the outer shape of the sheath 5, and is in intimate contact (areal contact) with the sheath 5. A surface pressure exerted by the sheath-covering portion 31 is applied to the outer surface 510 of the sheath 5.

The rubber stopper 3 of the present embodiment includes two wire-covering portions 32 that cover the respective corresponding cores 4. The wire-covering portions 32 are provided extending from the sheath-covering portion 31 in the longitudinal direction of the flat cable. The wire-covering portions 32 each includes a through hole 33 through which the corresponding insulated wire 40 is passed. One end of the through hole 33 is in communication with the inside of the tube of the sheath-covering portion 31. The insulated wire 40 extends from the other end of the through hole 33.

The waterproof cable 1 of the present embodiment is applicable, for example, in the field of vehicles such as automobiles, for use in an application in which a brake device attached to wheels and an electronic control unit attached to the vehicle body are connected, or the like.

Operations and effects of the flat cable 2 and the waterproof cable 1 according to the present embodiment will be described next. The sheath 5 includes the pair of sheath end portions 52, the coupling portions 53 that couple the pair of sheath end portions 52, and the reinforcing portions 54 that are provided outward of a portion of the coupling portions 53 that cover the hollow portion 51. Therefore, it is possible to inhibit the portion of the sheath 5 that covers the hollow portion 51 from being depressed inward when the rubber stopper 3 is attached to the terminal end portion 21 of the cable 2. This makes it possible to apply a sufficiently large surface pressure to the outer surface of the sheath 5 when the rubber stopper 3 is attached to the terminal end portion 21. As a result, the flat cable 2 can waterproof the terminal end portion 21 using the rubber stopper 3.

By providing the reinforcing portions 54 in the sheath 5, it is possible to sufficiently increase the surface pressure applied to the outer surface of the sheath 5 even when a rubber stopper 3 with a shape not corresponding to the shape of the sheath 5 is attached. Therefore, with the flat cable 2, it is possible to use the same rubber stopper 3 for a variety of flat cables 2 with different shapes and sizes. As a result, it is possible to expect the effect of reducing the time and labor, the cost, and the like required to change the shape of the rubber stopper 3.

The central portion 541 of the reinforcing portions 54 in the cable width direction has a thickness that is larger than the thickness of the end portions 542 thereof in the cable width direction. Accordingly, it is possible to further increase the surface pressure applied to the reinforcing portions 54 when the rubber stopper 3 is attached to the terminal end portion 21 of the flat cable 2. As a result, the waterproofing performance can be further enhanced.

The outer surface 543 of the reinforcing portions 54 has an arc shape in a cross section perpendicular to the longitudinal direction of the flat cable 2. Therefore, the unevenness on the outer surface 543 of the reinforcing portions 54 can be reduced, and it is more difficult for a gap to be formed between the rubber stopper 3 and the reinforcing portions 54. As a result, the waterproofing performance can be further enhanced.

The reinforcing portions 54 are provided over the entirety of the coupling portions 53 in the cable width direction. Accordingly, it is possible to apply a sufficiently large surface pressure to the entire reinforcing portions 54 when the rubber stopper 3 is attached to the terminal end portion 21 of the flat cable 2. As a result, the waterproofing performance can be further enhanced.

The outer surface 510 of the sheath 5 has an oval shape in a cross section perpendicular to the longitudinal direction of the flat cable 2. Therefore, it is more difficult for a gap to be formed between the rubber stopper 3 and the sheath 5, and it is possible to apply a sufficiently large surface pressure to the outer surface of the sheath 5 when the rubber stopper 3 is attached to the terminal end portion 21 of the flat cable 2. As a result, the waterproofing performance can be further enhanced.

As described above, the flat cable 2 of the present embodiment can waterproof the terminal end portion 21 using the rubber stopper 3.

The waterproof cable 1 includes the flat cable 2, and the rubber stopper 3 attached to the terminal end portion 21 of the flat cable 2. In the waterproof cable 1, by the sheath-covering portion 31 pressing the sheath end portions 52 and the reinforcing portions 54, it is possible to inhibit the entry of water or the like to the inside or the like of the sheath 5 from between the sheath-covering portion 31 and the sheath 5. By the wire-covering portions 32 pressing the protruding portions 43 of the insulated wires 40, it is possible to inhibit the entry of water or the like to the inside or the like of the insulated wires 40 from between the wire-covering portions 32 and the respective corresponding protruding portions 43. Therefore, the waterproof cable 1 of the present embodiment has excellent waterproofing performance.

Embodiment 2

The present embodiment is an embodiment of a flat cable 202 and a waterproof cable 102 in which cores 402 inside a sheath 5 are stranded-wire cores. Note that, of the reference numerals used in the present embodiment and embodiments described hereinafter, the same reference numerals as those used in the embodiment already described denote the same constituent elements and the like unless otherwise specified.

Figure 3:
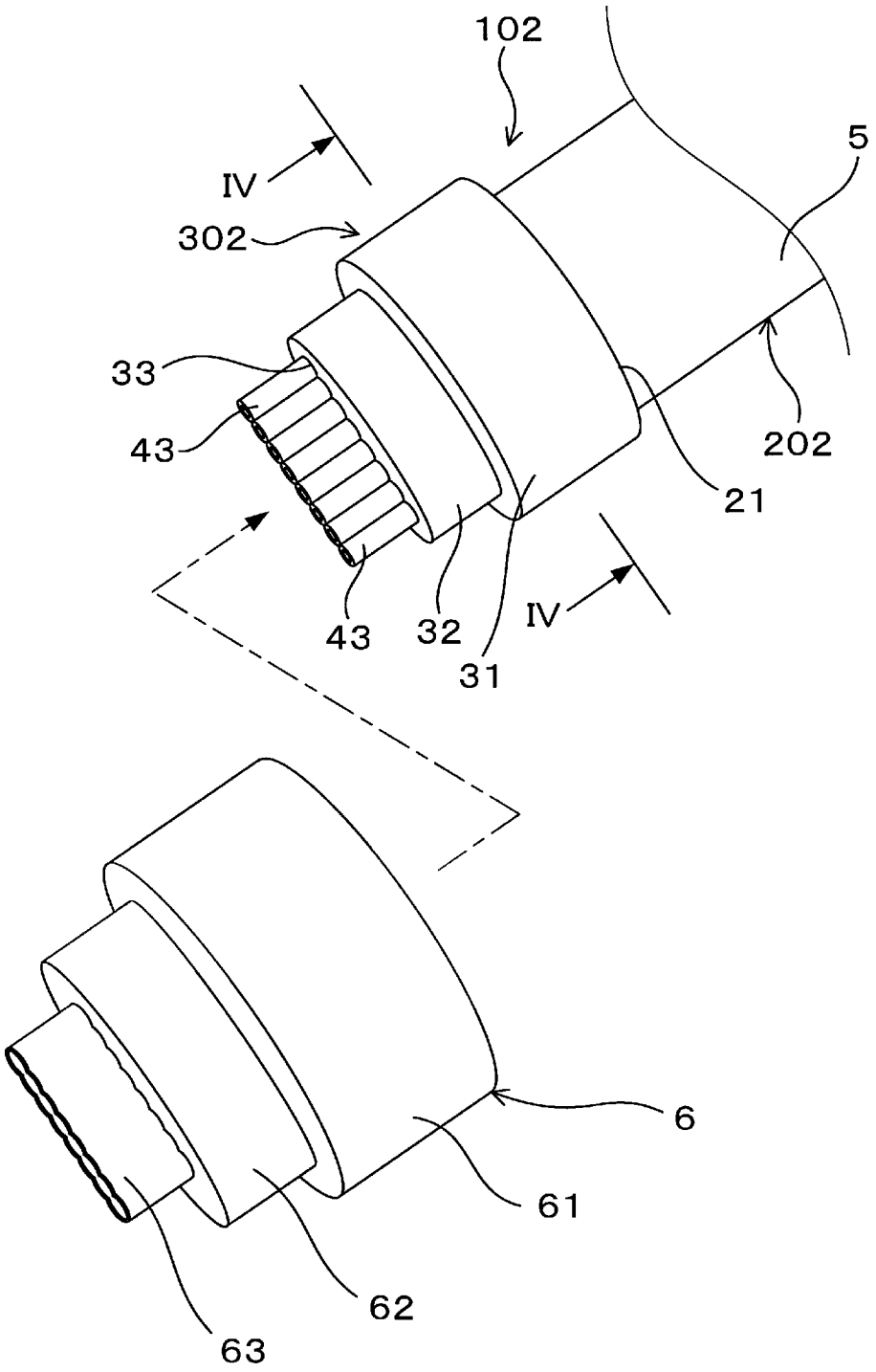
FIG. 3 is a perspective view of a waterproof cable including two stranded-wire cores according to Embodiment 2.
Figure 4:
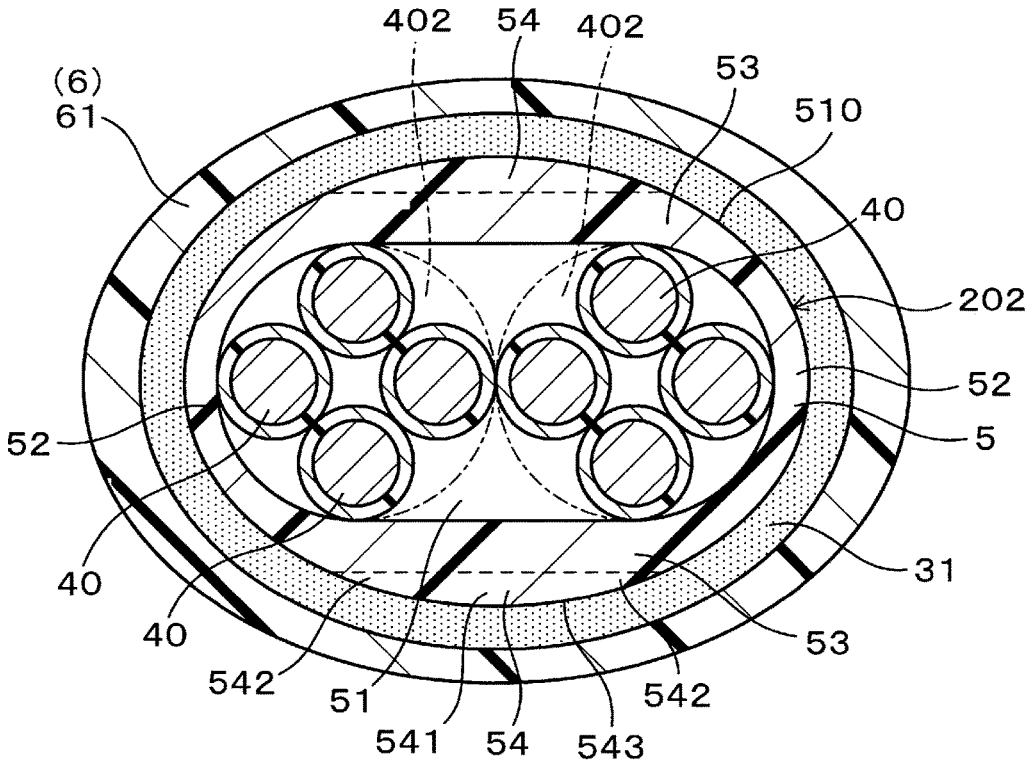
FIG. 4 is a cross-sectional view taken in the direction of allows IV-IV in FIG. 3.

As shown in FIG. 3, a waterproof cable 102 of the present embodiment includes a flat cable 202, and a rubber stopper 302 attached to a terminal end portion 21 of the flat cable 202. As shown in FIG. 4, two cores 402 are disposed inside a sheath 5 of the flat cable 202. The cores 402 of the present embodiment are each a stranded-wire core including four insulated wires 40 that are twisted together. Although not shown, the twist of each core 402 is released at the terminal end portion 21 of the flat cable 202. Consequently, eight insulated wires 40 protrude from the sheath 5 at the terminal end portion 21.

The rubber stopper 302 of the present embodiment includes a sheath-covering portion 31, and one wire-covering portion 32 that is connected with the sheath-covering portion 31. As shown in FIG. 4, eight through holes 33 lined up in the cable width direction are formed in the wire-covering portion 32. The insulated wires 40 are passed through the through holes 33, and extend to the outside of the rubber stopper 302 in a state in which they are lined up in the cable width direction.

As shown in FIGS. 3 and 4, the waterproof cable 102 of the present embodiment further includes a housing portion 6 attached to the rubber stopper 302. The housing portion 6 includes a sheath-pressing portion 61 that presses the sheath-covering portion 31 inward, and a wire-pressing portion 62 that presses the wire-covering portion 32 inward.

The sheath-pressing portion 61 of the present embodiment has a tubular shape that is slightly smaller than the outer shape of the sheath-covering portion 31. In a state in which the housing portion 6 is attached to the rubber stopper 302, the sheath-covering portion 31 is covered by the sheath-pressing portion 61.

The wire-pressing portion 62 is provided extending from the sheath-pressing portion 61 in the longitudinal direction of the flat cable 2, and has a tubular shape that is slightly smaller than the outer shape of the wire-covering portion 32. In a state in which the housing portion 6 is attached to the rubber stopper 302, the wire-covering portion 32 is covered by the wire-pressing portion 62.

The housing portion 6 of the present embodiment further includes a tubular portion 63 that is provided extending from the wire-pressing portion 62 in the longitudinal direction of the flat cable 2. The insulated wires 40 extending from the through holes 33 of the rubber stopper 302 are passed through the tubular portion 63. The rest of the configuration is the same as that of Embodiment 1.

Even in the case of using stranded-wire cores as in the present embodiment, the provision of the reinforcing portions 54 in the sheath 502 allows waterproofing of the flat cable 202 to be performed using the rubber stopper 302.

The waterproof cable 102 further includes the housing portion 6 including the sheath-pressing portion 61 that presses the sheath-covering portion 31 inward, and the wire-pressing portion 62 that presses the wire-covering portion 32 inward. By attaching the housing portion 6 to the rubber stopper 302, it is possible to reliably bring the sheath-covering portion 31 into intimate contact with the outer surface of the sheath 5, and also to reliably bring the wire-covering portion 32 into intimate contact with the outer surfaces of the insulated wires 40. Then, it is possible to further increase the surface pressure applied to the sheath 5 and the insulated wires 40. As a result, the waterproofing performance can be further enhanced. In addition, the flat cable 202 and the waterproof cable 102 of the present embodiment can achieve the same operations and effects as those achieved by Embodiment 1.

Embodiment 3

Figure 5:
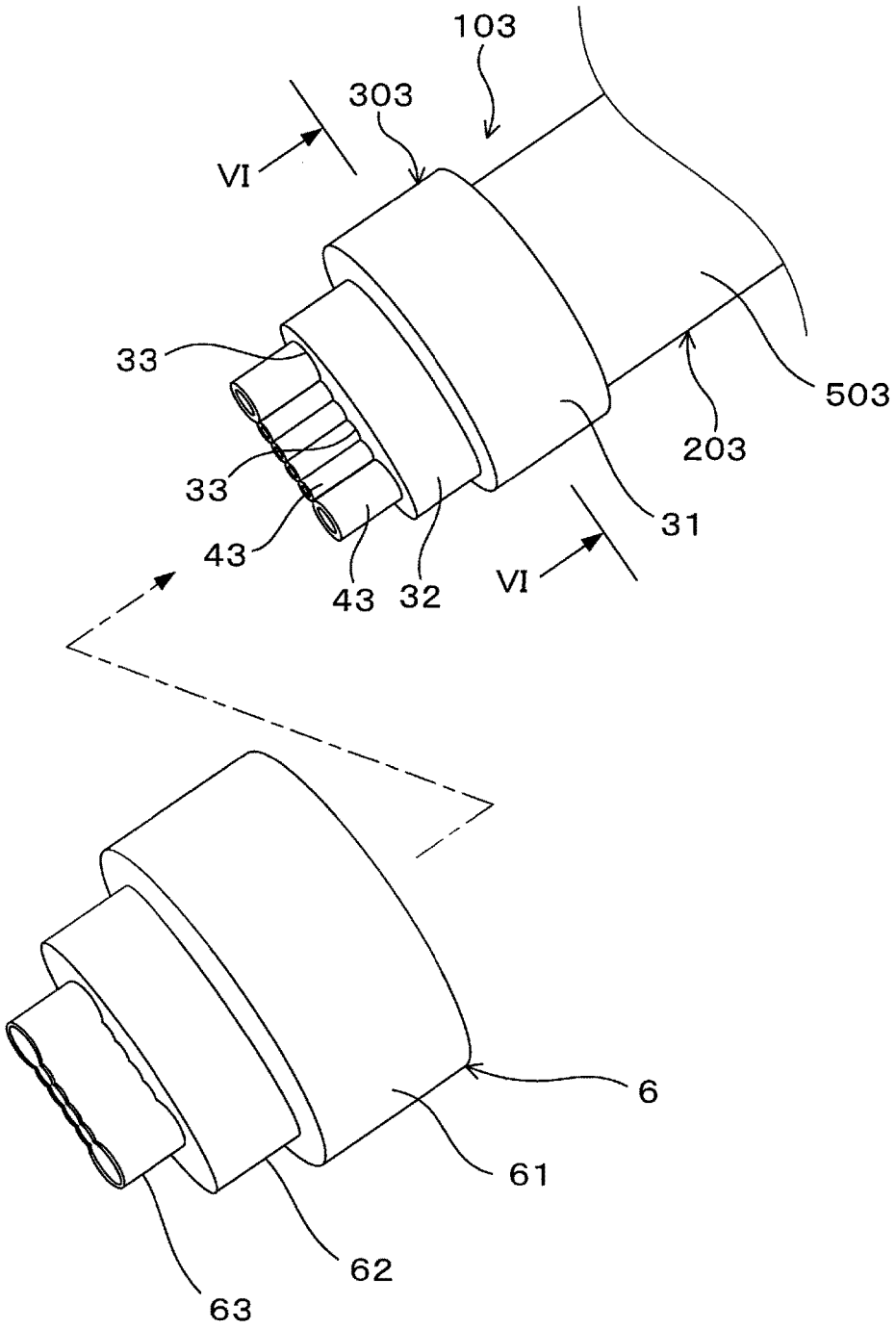
FIG. 5 is a perspective view of a waterproof cable in which single-wire cores and stranded-wire cores coexist, according to Embodiment 3.
Figure 6:
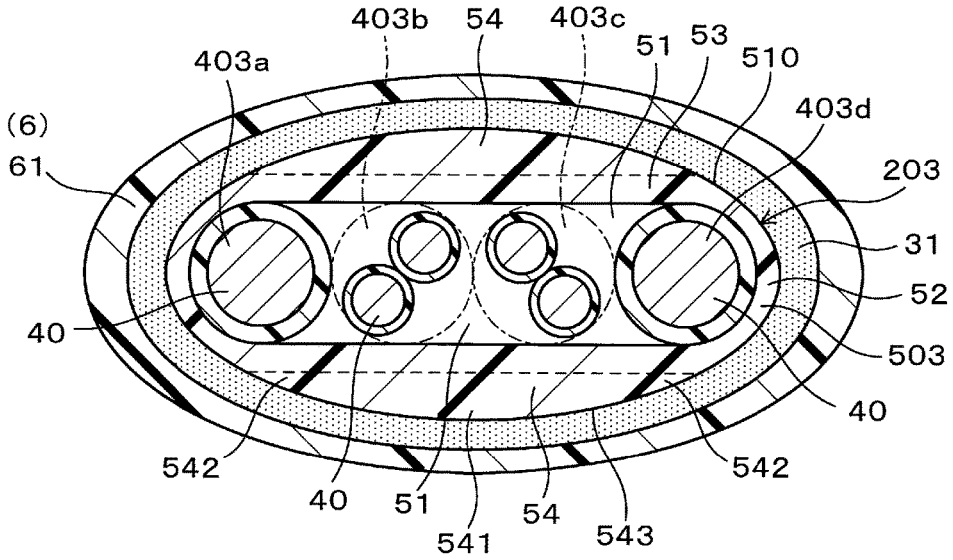
FIG. 6 is a cross-sectional view taken in the direction of arrows VI-VI in FIG. 5.

The present embodiment is an embodiment of a flat cable 203 and a waterproof cable 103 in which single-wire cores and stranded-wire cores coexist. As shown in FIGS. 5 and 6, a flat cable 203 of the present embodiment includes four cores 403 (403*a*, 403*b*, 403*c*, 403*d*) lined up in the cable width direction, and a sheath 503 that collectively covers the cores 403, and a hollow portion 51 is formed inside the sheath 503.

Of the four cores 403, each of the two cores 403*a* and 403*d* that are disposed outward in the cable width direction is a single-wire core constituted by one insulated wire 40. Each of the remaining two cores 403*b* and 403*c* is a stranded-wire core including two insulated wires 40 that are twisted together. The rest of the configuration is the same as that of Embodiment 2.

As in the present embodiment, single-wire cores and stranded-wire cores may coexist inside the sheath 303. The flat cable 203 and the waterproof cable 103 of the present embodiment can achieve the same operations and effects as those achieved by Embodiment 2.

Embodiment 4

Figure 7:
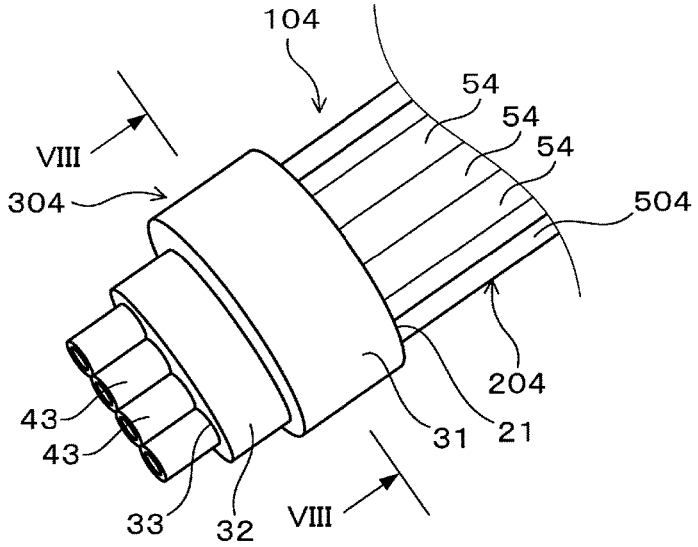
FIG. 7 is a perspective view of a waterproof cable including reinforcing portions that are formed so as to be divided for the respective corresponding hollow portions, according to Embodiment 4.
Figure 8:
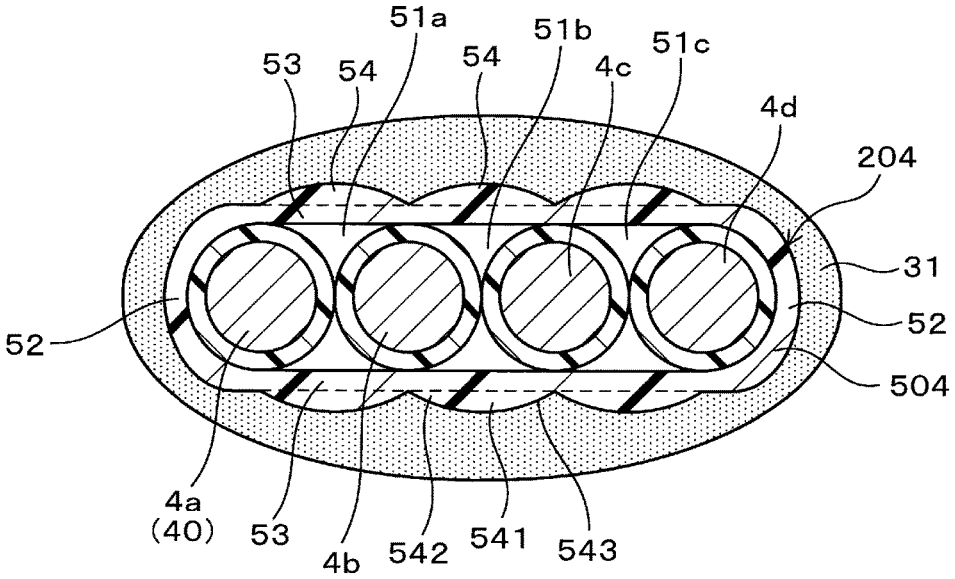
FIG. 8 is a cross-sectional view taken in the direction of allows VIII-VIII in FIG. 7.

The present embodiment is an embodiment of a flat cable 204 and a waterproof cable 104 that include reinforcing portions 54 that are formed so as to be divided for the respective corresponding hollow portions 51. As shown in FIGS. 7 and 8, the flat cable 204 of the present embodiment includes four cores 4 (4*a*, 4*b*, 4*c*, 4*d*) lined up in the cable width direction, and a sheath 504 that collectively covers the cores 4, and a hollow portion 51 is formed inside the sheath 504. Note that each of the cores 4 of the present embodiment is a single-wire core as shown in FIG. 8.

As shown in FIG. 8, the reinforcing portions 54 of the sheath 504 of the present embodiment are provided so as to be separated for the respective corresponding portions of the coupling portions 53 that cover the hollow portion 51. That is, when the leftmost core 4 in FIG. 8 is referred to as a first core 4*a*, and the other cores 4 are referred to as a second core 4*b*, a third core 4*c*, and a fourth core 4*d* in order from the core 4 closest to the first core 4*a*, reinforcing portions 54 are respectively provided for a hollow portion 51*a* between the first core 4*a* and the second core 4*b*, a hollow portion 51*b* between the second core 4*b* and the third core 4*c*, and a hollow portion 51*c* between the third core 4*c* and the fourth core 4*d*.

A central portion 541 of each reinforcing portion 54 in the cable width direction has a thickness that is larger than the thickness of end portions 542 thereof in the cable width direction. An outer surface 543 of the reinforcing portions 54 has an arc shape in a cross section perpendicular to the longitudinal direction of the flat cable 204. The rest of the configuration is the same as that of Embodiment 2.

In the flat cable 204 of the present embodiment, the central portion 541 of the reinforcing portions 54 in the cable width direction has a thickness that is larger than the thickness of the end portions 542 thereof in the cable width direction. Accordingly, it is possible to further increase the surface pressure applied to the reinforcing portions 54 when the rubber stopper 3 is attached to the terminal end portion 21 of the flat cable 204. As a result, the waterproofing performance can be further enhanced.

Since the outer surface of the reinforcing portions 54 has an arc shape in a cross section perpendicular to the longitudinal direction of the flat cable 204, it is more difficult for a gap to be formed between the rubber stopper 3 and the reinforcing portions 54. As a result, the waterproofing performance can be further enhanced.

Note that the flat cable and the waterproof cable according to the present disclosure are not limited to the configurations described in Embodiments 1 to 4, and may be changed as appropriate without departing from the gist of the disclosure. For example, although Embodiments 1 to 4 show examples in which the outer surface of the reinforcing portions 54 has an arc shape in a cross section perpendicular to the longitudinal direction of the flat cable 2, 202, 203, or 204, the outer surface of the reinforcing portions 54 may be flat.

Although Embodiments 2 and 3 show examples in which the sheath-pressing portion 61 and the wire-pressing portion 62 have tubular shapes that are slightly narrower than the outer shapes of the sheath-covering portion 31 and the wire-covering portion 32, it is possible to change the shapes of the sheath-pressing portion 61 and the wire-pressing portion 62. For example, the sheath-pressing portion 61 and the wire-pressing portion 62 may each be a projection provided inward of the housing portion 6. In this case, by pressing the sheath-covering portion 31 and the wire-covering portion 32 by the projections, it is possible to bring the sheath-covering portion 31 and the wire-covering portion 32 into intimate contact with the sheath 5 and the insulated wire 40, respectively.

The inner shape of the housing portion 6 may be the same as the outer shape of the rubber stopper 3, 302, 303, or 304. In this case, for example, a separate member may be provided outward of the housing portion 6, and, by pressing the housing portion 6 inward by that member, it is possible to form the sheath-pressing portion 61 and the wire-pressing portion 62 that respectively press the sheath-covering portion 31 and the wire-covering portion 32 inward.

The invention claimed is:

1. A flat cable comprising:

a plurality of cores each including one insulated wire and/or a plurality of insulated wires that are twisted together, the cores being lined up in a cable width direction, which is orthogonal to a longitudinal direction of the insulated wires;

a sheath that collectively covers the plurality of cores; and a space that is surrounded by an outer surface of one of the plurality of cores, an outer surface of another one of the plurality of cores that is adjacent to the one of the plurality of cores, and an inner surface of the sheath, wherein the sheath includes:

a pair of sheath sends respectively located along outer surfaces of cores of the plurality of cores that are disposed at opposite ends;

a coupler that couples the pair of sheath ends; and a reinforcement that is formed integrally with the coupler, and is provided outward of a portion of the coupler that covers the space.

2. The flat cable according to claim 1, wherein a central portion of the reinforcement in the cable width direction has a thickness that is larger than a thickness of an end portion thereof in the cable width direction.

3. The flat cable according to claim 2, wherein an outer surface of the reinforcement has an arc shape in a cross section perpendicular to a longitudinal direction of the flat cable.

4. The flat cable according to claim 1, wherein the reinforcement is provided over an entirety of the coupler in the cable width direction.

5. The flat cable according to claim 1, wherein an outer surface of the sheath has an oval shape in a cross section perpendicular to a longitudinal direction of the flat cable.

6. A waterproof cable comprising:

the flat cable according to claim 1; and a rubber stopper attached to a terminal end of the flat cable, wherein the terminal end includes the sheath, and the insulated wires protruding from the sheath, and the rubber stopper includes:

a sheath-covering that covers the sheath;

a wire-covering that is connected with the sheath-covering, and that covers a protrusion of the insulated wires; and a through hole that is formed in the wire-covering, and through which each of the protrusions is passed.

7. The waterproof cable according to claim 6, further comprising a housing that covers the rubber stopper, wherein the housing includes a sheath-pressing pressing the sheath-covering inward, and a wire-pressing pressing the wire-covering inward.

* * * * *